US008857810B2

(12) United States Patent
Yoshii et al.

(10) Patent No.: US 8,857,810 B2
(45) Date of Patent: Oct. 14, 2014

(54) SHEET FEEDING DEVICE, SHEET CONTAINING DEVICE, AND IMAGE FORMING APPARATUS

(71) Applicant: Fuji Xerox Co., Ltd., Tokyo (JP)

(72) Inventors: Hajime Yoshii, Kanagawa (JP); Mitsuhiro Nakamura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/707,687

(22) Filed: Dec. 7, 2012

(65) Prior Publication Data

US 2013/0292896 A1 Nov. 7, 2013

(30) Foreign Application Priority Data

May 1, 2012 (JP) ..... 2012-104716

(51) Int. Cl.

| | |
|---|---|
| ***B65H 3/14*** | (2006.01) |
| ***B65H 3/06*** | (2006.01) |
| ***B65H 3/08*** | (2006.01) |
| ***G03G 15/00*** | (2006.01) |
| ***B41J 13/10*** | (2006.01) |
| ***B65H 1/14*** | (2006.01) |
| ***B65H 3/48*** | (2006.01) |
| ***B65H 7/04*** | (2006.01) |

(52) U.S. Cl.

CPC ..... *B65H 3/08* (2013.01); *B65H 3/0684* (2013.01); *B65H 2406/1211* (2013.01); *G03G 15/6511* (2013.01); *B41J 13/103* (2013.01); *B65H 1/14* (2013.01); *B65H 3/48* (2013.01); *B65H 2801/06* (2013.01); *B65H 2511/515* (2013.01); *B65H 2403/421* (2013.01); *B65H 2405/332* (2013.01); *B65H 2404/14211* (2013.01); *B65H 7/04* (2013.01); *B65H 2511/152* (2013.01); *B65H 3/0669* (2013.01); *B65H 2513/40* (2013.01); *B65H 2515/212* (2013.01)

USPC ..... 271/97; 271/30.1; 271/90

(58) Field of Classification Search

USPC ..... 271/90, 91, 96, 97, 98, 30.1

See application file for complete search history.

(56) References Cited

U.S. PATENT DOCUMENTS

| | | | | |
|---|---|---|---|---|
| 6,015,144 | A | 1/2000 | Yoshii et al. | |
| 6,955,348 | B2 * | 10/2005 | Koga | 271/97 |
| 7,451,973 | B2 * | 11/2008 | Koga et al. | 271/97 |
| 7,708,264 | B2 * | 5/2010 | Kosugi et al. | 271/97 |
| 8,002,265 | B2 * | 8/2011 | Suzuki | 271/98 |

(Continued)

FOREIGN PATENT DOCUMENTS

| | | | |
|---|---|---|---|
| JP | 11-005643 | A | 1/1999 |
| JP | 2002-128300 | A | 5/2002 |

*Primary Examiner* — Ernesto Suarez

(74) *Attorney, Agent, or Firm* — Sughrue Mion, PLLC

(57) ABSTRACT

A sheet feeding device includes a loading section on which sheets are loaded, a delivery section that sequentially delivers the sheets from a top of a stack of the sheets having a side surface loaded on the loading section, a blowing section that has a blowing opening, which opens opposite the side surface of the stack of sheets loaded on the loading section, and that blows air toward the side surface of the stack of sheets through the blowing opening, an inclination section that causes the stack of sheets loaded on the loading section to be inclined in accordance with the quantity of the sheets loaded on the loading section, and a setting section that sets a position of the blowing opening of the blowing section in accordance with an amount of inclination of the stack of sheets that are inclined by the inclination section.

10 Claims, 9 Drawing Sheets

(56) References Cited

U.S. PATENT DOCUMENTS 8,113,501 B2 * 2/2012 Uji et al. ..... 271/97
8,186,668 B2 * 5/2012 Wardak et al. ..... 271/97
8,419,009 B2 * 4/2013 Yoshii ..... 271/97

* cited by examiner

SHEET FEEDING DEVICE, SHEET CONTAINING DEVICE, AND IMAGE FORMING APPARATUS

CROSS-REFERENCE TO RELATED APPLICATIONS

This application is based on and claims priority under 35 USC 119 from Japanese Patent Application No. 2012-104716 filed May 1, 2012.

BACKGROUND

Technical Field

The present invention relates to a sheet feeding device, a sheet containing device, and an image forming apparatus.

SUMMARY

According to an aspect of the present invention, a sheet feeding device includes a loading section on which sheets are loaded, a delivery section that sequentially delivers the sheets from a top of a stack of the sheets having a side surface loaded on the loading section, a blowing section that has a blowing opening, which opens opposite the side surface of the stack of sheets loaded on the loading section, and that blows air toward the side surface of the stack of sheets through the blowing opening, an inclination section that causes the stack of sheets loaded on the loading section to be inclined in accordance with the quantity of the sheets loaded on the loading section, and a setting section that sets a position of the blowing opening of the blowing section in accordance with an amount of inclination of the stack of sheets that are inclined by the inclination section.

BRIEF DESCRIPTION OF THE DRAWINGS

Exemplary embodiments of the present invention will be described in detail based on the following figures, wherein.

DETAILED DESCRIPTION

Exemplary embodiments of the present invention will be described in detail below with reference to the accompanying drawings.

First Exemplary Embodiment

Figure 1:
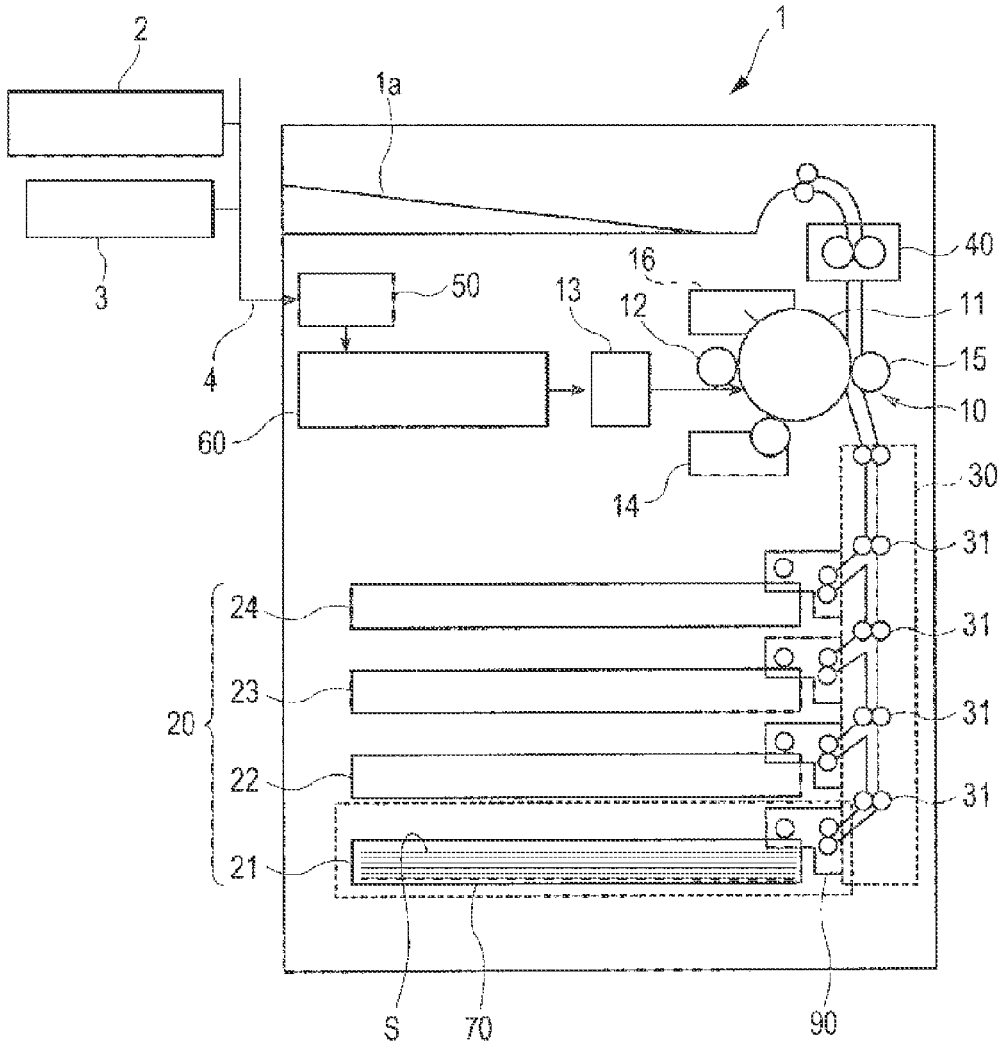
FIG. 1 illustrates an example of a general configuration of an image forming apparatus.

FIG. 1 illustrates an example of a general configuration of an image forming apparatus 1 to which a first exemplary embodiment is applied. The image forming apparatus 1 is connected to an image reader 2, which reads an image in a document, and external equipment 3, which includes a personal computer and the like, through a communication line 4. The image forming apparatus 1 forms an image on a sheet of paper S in accordance with image information transmitted from the image reader 2 or the external equipment 3.

The image forming apparatus 1 includes an image forming unit 10, a sheet feeding arrangement 20, a sheet transport unit 30, a fixing unit 40, and a sheet output unit 1*a*. The image forming unit 10 forms an image on the sheet of paper S, which serves as an example of a sheet. The sheet feeding arrangement 20 feeds the sheet S toward the image forming unit 10. The sheet transport unit 30 transports the sheet S fed from the sheet feeding arrangement 20 to the image forming unit 10. The fixing unit 40 fixes the image formed on the sheet S by the image forming unit 10. The sheet output unit 1*a* is provided in an upper portion of the image forming apparatus 1. The sheet S, onto which an image is fixed due to passage of the sheet S through the fixing unit 40, is placed on the sheet output unit 1*a*. The image forming apparatus 1 further includes a receiver unit 50 and a controller 60. The receiver unit 50 receives image information input through the communication line 4. The controller 60 generates an exposure signal to be used in the image forming unit 10 in accordance with the image information received by the receiver unit 50 and controls operation of each component included in the image forming apparatus 1.

Out of the above-described components, the image forming unit 10 includes a photoconductor drum 11, a charger 12, an exposure device 13, a developing device 14, a transfer device 15, and a cleaner 16. The photoconductor drum 11 has a photosensitive layer (not shown) and is rotatably provided. The charger 12 charges the photoconductor drum 11. The exposure device 13 forms an electrostatic latent image by selectively emitting a beam to the charged photoconductor drum 11 in accordance with the exposure signal supplied from the controller 60. The developing device 14 forms a toner image by developing the electrostatic latent image formed on the photoconductor drum 11 with toner. The transfer device 15 transfers the toner image formed on the photoconductor drum 11 onto the sheet S. The cleaner 16 removes the residual toner remaining on the photoconductor drum 11 after the toner image has been transferred.

The sheet feeding arrangement 20 includes a first sheet feeding unit 21, a second sheet feeding unit 22, a third sheet feeding unit 23, and a fourth sheet feeding unit 24. The first to fourth sheet feeding units 21 to 24 are disposed below the image forming unit 10 and each feeds the sheet S to the sheet transport unit 30. In the present exemplary embodiment, the first to fourth sheet feeding units 21 to 24 are stacked in the order of the first sheet feeding unit 21, the second sheet feeding unit 22, the third sheet feeding unit 23, and the fourth sheet feeding unit 24 from a lower side to an upper side, that is, toward the side closer to the image forming unit 10. The fourth sheet feeding unit 24, which is located at the uppermost position among the first to fourth sheet feeding units 21 to 24, is initially incorporated in a body unit of the image forming apparatus 1, the body unit including components such as the image forming unit 10 and the fixing unit 40. The other sheet feeding units, that is, the first to third sheet feeding units 21 to 23 are integrated as a separate unit and attached to the body unit. In the present exemplary embodiment, since the first to fourth sheet feeding units 21 to 24 have a common structure, the first sheet feeding unit 21 is described as an example hereafter. In the present exemplary embodiment, each of the first to fourth sheet feeding units 21 to 24 included in the sheet feeding arrangement 20 has the function of a sheet feeding unit or a sheet feeding device.

The first sheet feeding unit 21 includes a sheet containing portion 70 and a sheet feed mechanism 90. The sheet containing portion 70 contains a stack of the sheets S therein, each of which is a medium on which an image is formed. The sheet feed mechanism 90 picks up the sheets one by one from the stack of sheets S contained in the sheet containing portion 70 so as to feed the sheet S to the sheet transport unit 30. Here, the sheet containing portion 70 may be pulled to a front side of the image forming apparatus 1 (front side) illustrated in FIG. 1. The sheet containing portion 70 may be replenished with the new sheets S when the sheet containing portion 70 is pulled forward. However, the sheet feed mechanism 90 remains in the image forming apparatus 1 while the sheet containing portion 70 is pulled to the front side of the image forming apparatus 1.

The sheet transport unit 30 has a transport path (not denoted by a reference numeral) and plural transport rollers 31. The transport path allows the sheet S fed from each of the first to fourth sheet feeding units 21 to 24, which are included in the sheet feeding arrangement 20, to be transported therethrough toward the image forming unit 10 (more specifically, a transfer portion where the photoconductor drum 11 and the transfer device 15 oppose each other). The transport rollers 31 transport the sheet S by nipping therebetween in the transport path.

Next, image forming operation using the image forming apparatus 1 illustrated in FIG. 1 is described.

When image information is received by the receiver unit 50, which is provided in the image forming apparatus 1, from the image reader 2 or the external equipment 3 through the communication line 4, the controller 60 generates an exposure signal in accordance with the image information, outputs the exposure signal to the exposure device 13, and also outputs a control signal indicative of the start of operation to each component included in the image forming apparatus 1.

As a result, in the image forming unit 10, the rotating photoconductor drum 11 is charged with the charger 12 and then the exposure device 13 emits a beam. At this time, the exposure device 13 emits the beam in accordance with the exposure signal input thereto from the controller 60. An electrostatic latent image having been formed on the photoconductor drum 11 as a result of charging and exposure to the beam is transformed into a toner image through developing performed by the developing device 14 and moved toward the transfer portion where the photoconductor drum 11 and the transfer device 15 oppose each other.

In the sheet feeding arrangement 20, the sheet S is fed from one of the sheet feeding units (for example, the first sheet feeding unit 21) where the sheets S, each of which is a medium on which the image is formed, are contained. That is, the sheets S contained in the sheet containing portion 70 of the first sheet feeding unit 21 are picked up one after another using the sheet feed mechanism 90 and fed to the sheet transport unit 30. After that, the transport rollers 31 provided in the sheet transport unit 30 transport the sheet S having been fed from the first sheet feeding unit 21 to the transfer portion at a timing adjusted to arrival of the toner image on the photoconductor drum 11 at the transfer portion.

The toner image formed on the photoconductor drum 11 is transferred to the sheet S by the transfer device 15 while the sheet S is passing through the transfer portion. Then, the sheet S, onto which the toner image is transferred due to passage of the sheet S through the transfer portion, passes through the fixing unit 40. The toner image is fixed on the sheet S due to passage of the sheet S through the fixing unit 40. After that, the sheet S is ejected to the sheet output unit 1*a*. The toner remaining on the photoconductor drum 11 after the sheet S has passed through the transfer portion is removed by the cleaner 16.

Next, the first sheet feeding unit 21 as an example of the sheet feeding units included in the sheet feeding arrangement 20 is described in more detail.

Figure 2:
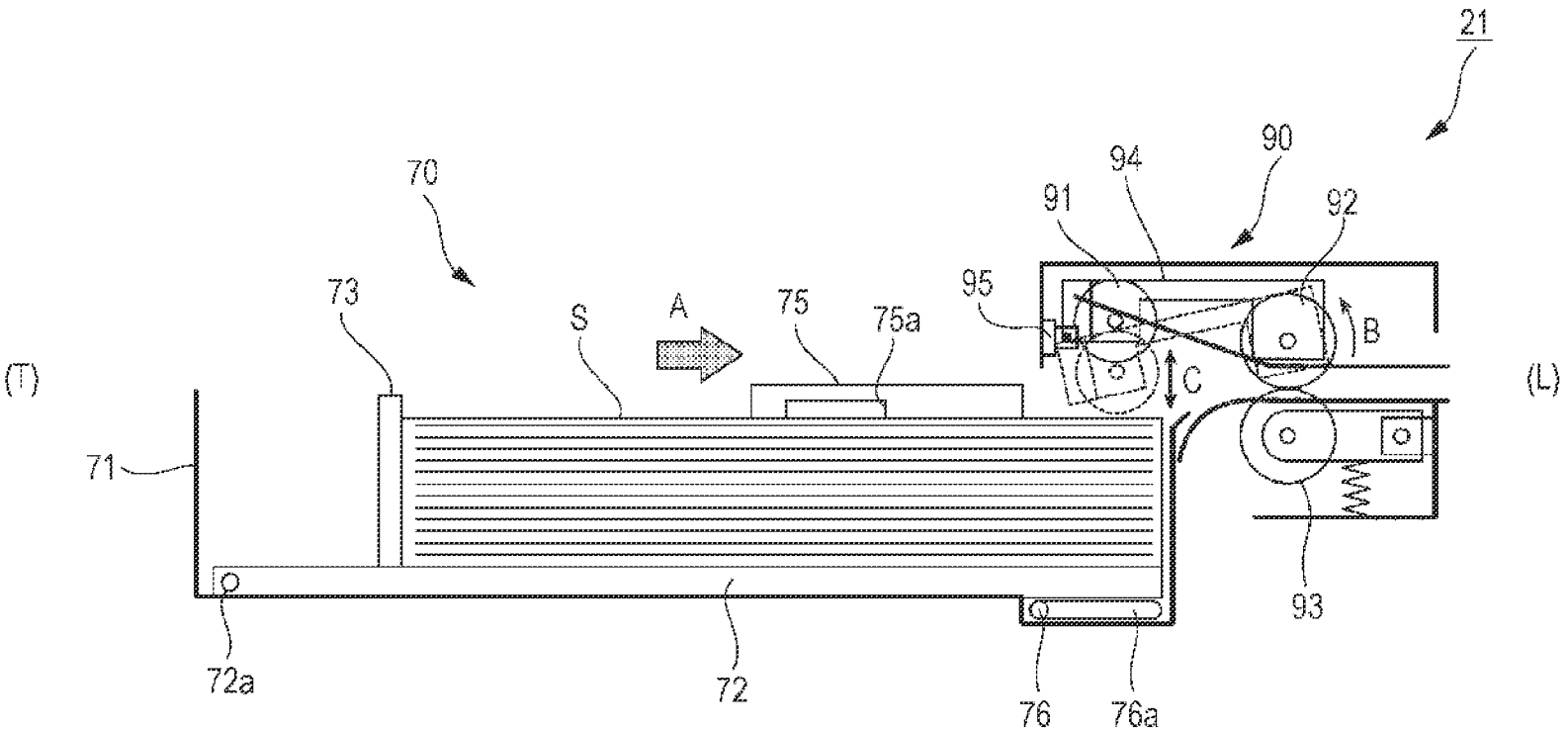
FIG. 2 illustrates an example of the sectional structure of a first sheet feeding unit fully loaded with sheets of paper seen from the front side of the image forming apparatus.
Figure 3:
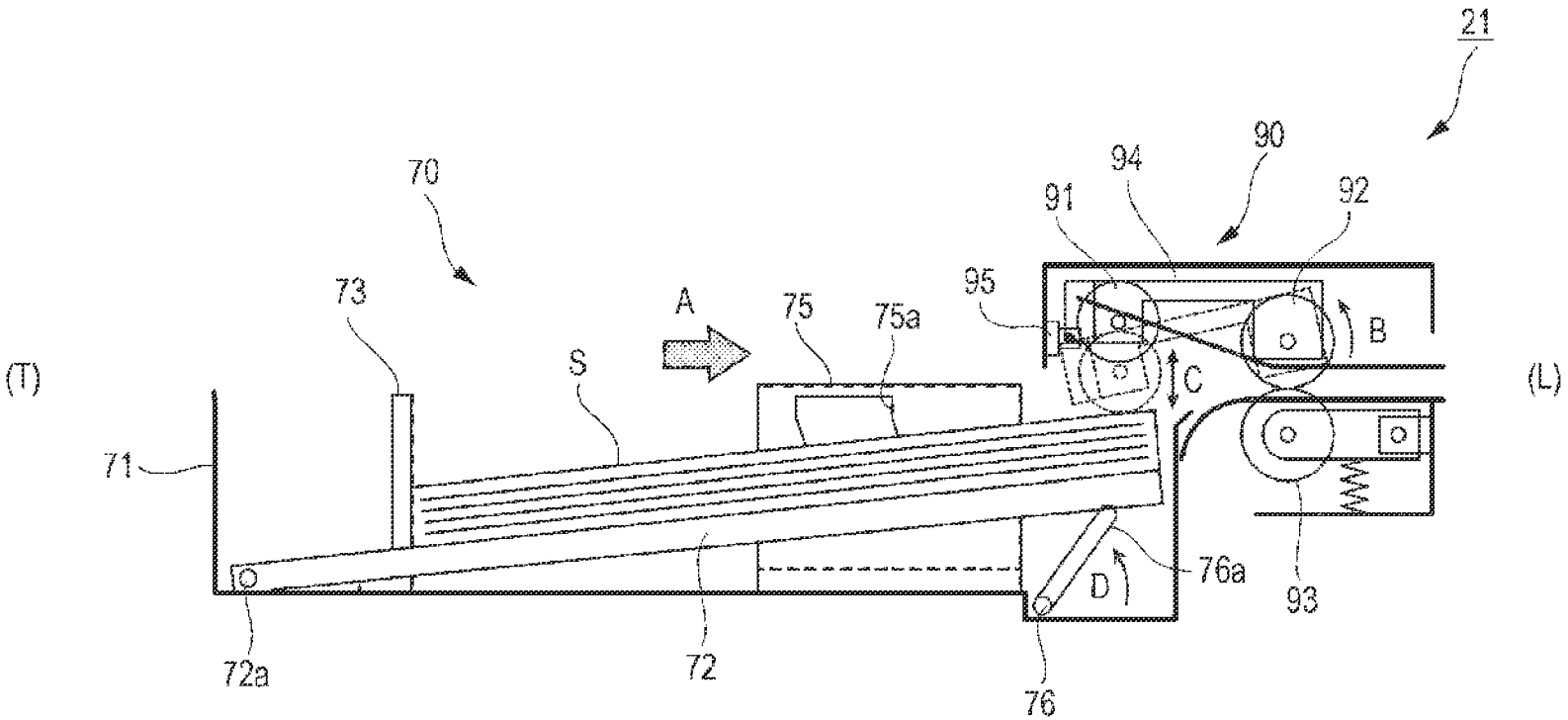
FIG. 3 illustrates an example of the sectional structure of the first sheet feeding unit loaded with about half as many sheets of paper as is possible seen from the front side of the image forming apparatus.
Figure 4:
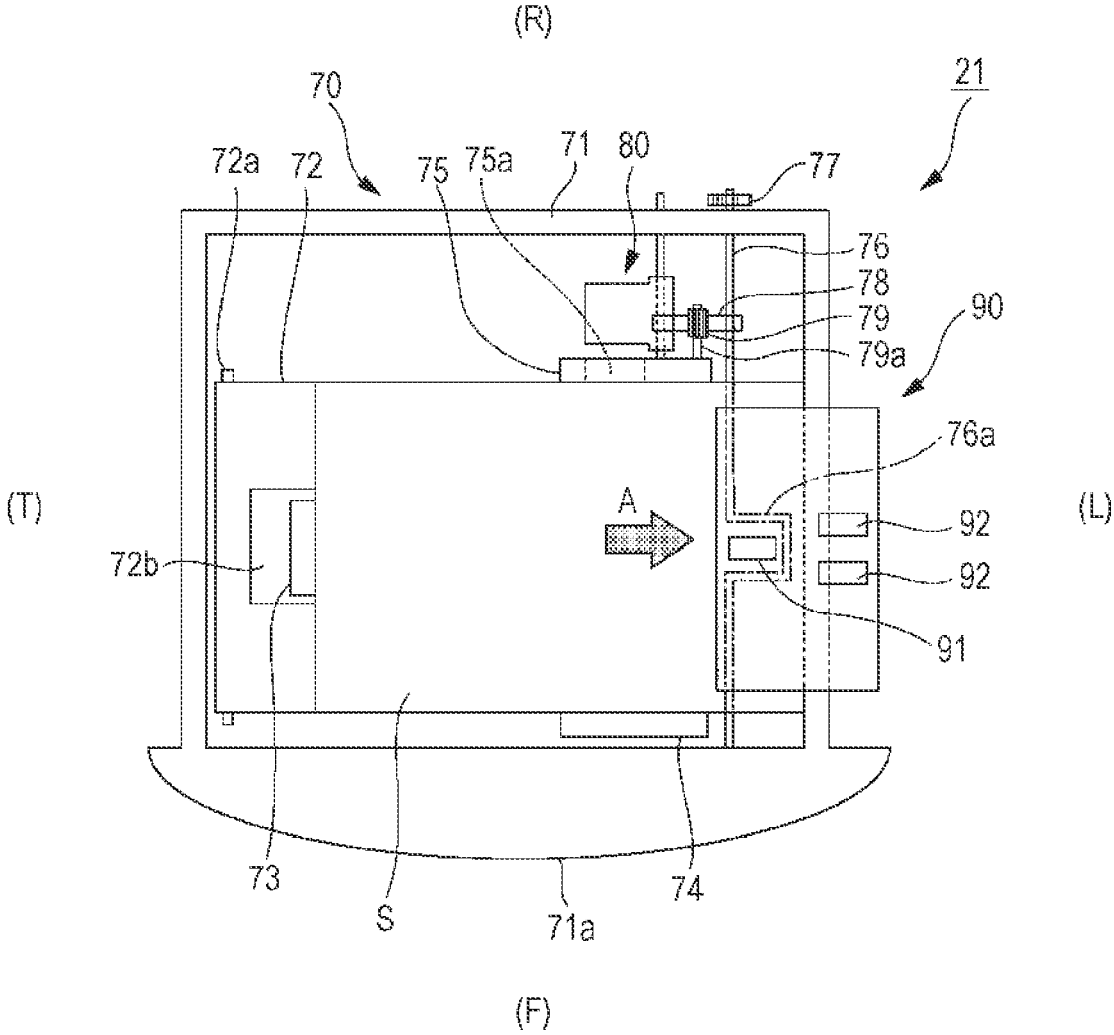
FIG. 4 is a top view of the first sheet feeding unit seen from the top of the image forming apparatus.
Figure 5:
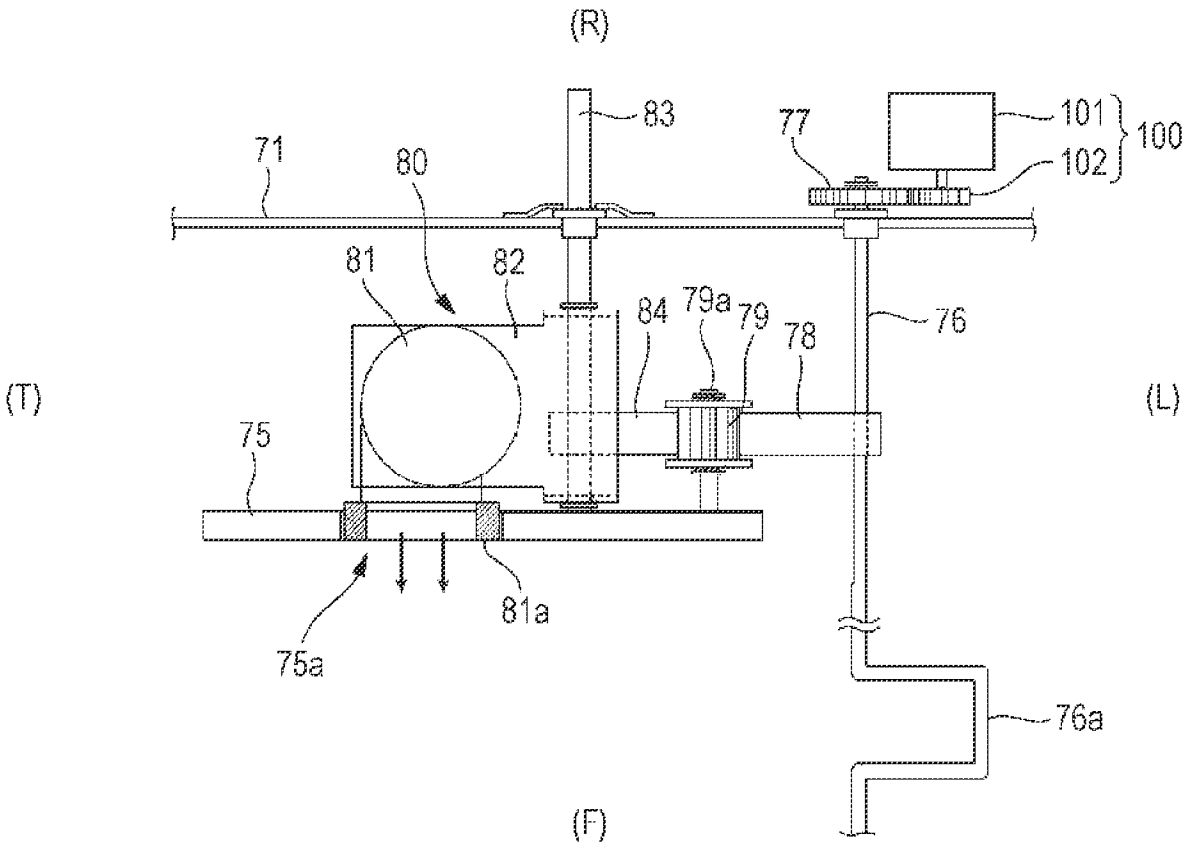
FIG. 5 is an enlarged top view of a blowing unit and an area around the blowing unit of the first sheet feeding unit according to a first exemplary embodiment.
Figure 6A:
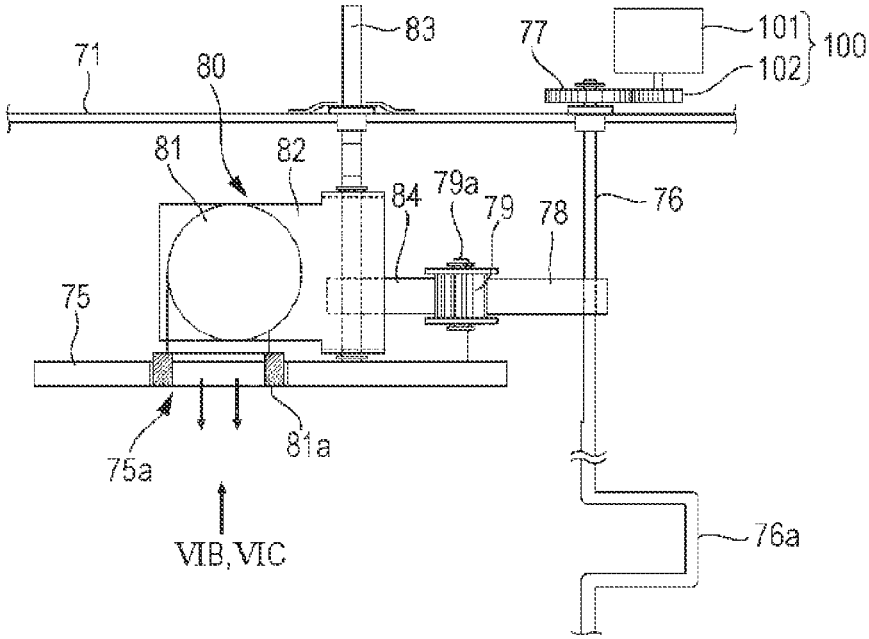
FIGS. 6A to 6C illustrate behaviors of a lift-up arm portion and a blowing opening in the first sheet feeding unit according to the first exemplary embodiment.
Figure 6B:
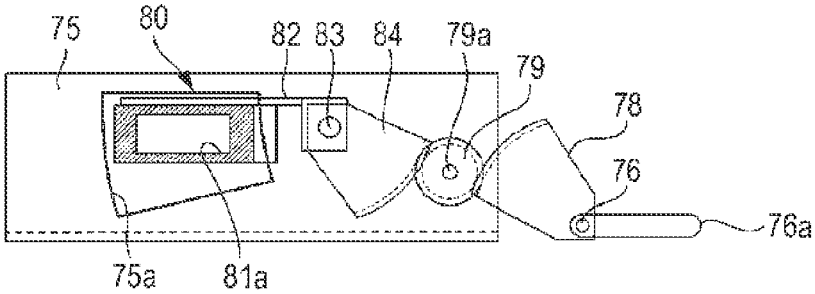
Figure 6C:
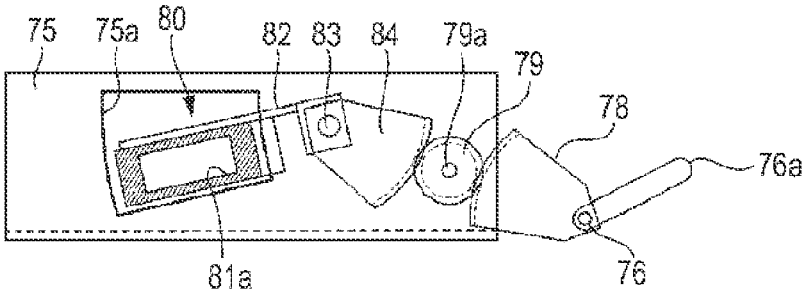

FIG. 2 illustrates an example of the sectional structure of the first sheet feeding unit 21 seen from the front side of the image forming apparatus 1. In FIG. 2, the first sheet feeding unit 21 is fully loaded with the sheets S (referred to as a first state hereafter). FIG. 3 illustrates an example of the sectional structure of the first sheet feeding unit 21 seen from the front side of the image forming apparatus 1. In FIG. 3, the first sheet feeding unit 21 is loaded with about half as many sheets S as is possible (referred to as a second state hereafter). FIG. 4 is a top view of the first sheet feeding unit 21 seen from the top of the image forming apparatus 1. FIG. 5 is an enlarged top view of a blowing unit 80 (the details of the blowing unit 80 will be described later) and an area around the blowing unit 80 of the first sheet feeding unit 21. FIGS. 6A to 6C illustrate behaviors of a lift-up arm portion 76*a* and a blowing opening 81*a* of the first sheet feeding unit 21. The details of the lift-up arm portion 76*a* and the blowing opening 81*a* will be described later. Out of FIGS. 6A to 6C, FIG. 6A is an enlarged top view of the blowing unit 80 and the area around the blowing unit 80 (similar to FIG. 5), FIG. 6B illustrates the first sheet feeding unit 21 in the first state illustrated in FIG. 2 seen in a VIB direction indicated in FIGS. 6A, and FIG. 6C illustrates the first sheet feeding unit 21 in the second state illustrated in FIG. 3 seen in a VIC direction indicated in FIG. 6A. Here, the first sheet feeding unit 21 according to the present exemplary embodiment includes the sheet containing portion 70 and the sheet feed mechanism 90 as described above, and the blowing unit 80 is provided on the sheet containing portion 70 side.

In the following description, as denoted in the parentheses in, for example, FIG. 4, in a state in which the first sheet feeding unit 21 including the sheet containing portion 70 and the sheet feed mechanism 90 is attached to the image forming apparatus 1, sides on the front and rear of the image forming apparatus 1 are respectively referred to as "front side F" and "rear side R"; a leading (right side in FIG. 4) and trailing (left side in FIG. 4) sides in a direction in which the sheet S is transported are respectively referred to as "leading side L" and "trailing side T".

Initially, the configuration of the sheet containing portion 70 of the first sheet feeding unit 21 is described.

The sheet containing portion 70 as an example of a sheet containing device includes a housing 71 and a sheet loading plate 72. The housing 71 is open at the top and has a box-shaped space formed thereinside. The plate-shaped sheet loading plate 72 is attached to the sheet containing portion 70 so as to be rotatable about a support shaft 72*a*, which is attached to an upper position of a lower surface of the housing 71 on the trailing side T of the housing 71. The sheet loading plate 72, on which the sheets S are loaded, is provided on an upper surface side of the support shaft 72*a*. A grip portion 71*a* is provided on the front side F of the housing 71. The grip portion 71*a* is used to pull the sheet containing portion 70 from the inside of the image forming apparatus 1 to the front side F or to push the sheet containing portion 70, which has been pulled, into the image forming apparatus 1. The sheet loading plate 72 serving as an example of a loading section or a loading member has a rectangular shape when seen from the top and extends from an end portion on the trailing side T to an end portion on the leading side L in the box-shaped space formed inside the housing 71. The sheet loading plate 72 has an opening 72*b* used for attachment of an end guide 73, which will be described later.

The sheet containing portion 70 includes the end guide 73, a front side guide 74, and a rear side guide 75, which are respectively regulate end positions of the sheet S loaded on the sheet loading plate 72 on the trailing side T, on the front side F, and on the rear side R. In the present exemplary embodiment, the end position of the sheet S loaded on the sheet loading plate 72 on the leading side L is regulated by a side wall of the housing 71 on the leading side L.

A lower end side of the end guide 73 is attached to the lower surface of the housing 71 and the upper end side of the end guide 73 is a plate-shaped member that extends from the front side F to the rear side R. Here, the end guide 73 according to the present exemplary embodiment is inserted through the opening 72*b* formed in the sheet loading plate 72 attached to the housing 71. The end guide 73 is slidable relative to the housing 71 between the trailing side T and the leading side L. The position at which the end guide 73 is secured to is changeable in accordance with the size (length in the transportation direction) of the sheet S contained in the housing 71. Thus, the size of the opening 72*b* formed in the sheet loading plate 72 is set in accordance with the movable range of the end guide 73.

A lower end side of the front side guide 74 is attached to the lower surface of the housing 71 and the upper end side of the front side guide 74 is a plate-shaped member that extends from the leading side L to the trailing side T. The front side guide 74 is slidable relative to the housing 71 between the front side F and the rear side R. The position at which the front side guide 74 is secured is changeable in accordance with the size (length is the width direction) of the sheet S contained in the housing 71.

A lower end side of the rear side guide 75 is attached to the lower surface of the housing 71 and the upper end side of the rear side guide 75 is a plate-shaped member that extends from the leading side L to the trailing side T. The rear side guide 75 is provided at a position opposing the front side guide 74 with the sheet loading plate 72 interposed therebetween and secured to the housing 71. The rear side guide 75 has an opening 75*a* that extends therethrough from the front side F to the rear side R.

Furthermore, the sheet containing portion 70 includes a lift-up shaft 76. The lift-up shaft 76 is provided on the leading side L of the housing 71 and used to adjust inclination (lifting angle) of the sheet loading plate 72 about the support shaft 72*a* by lifting up the leading side L of the sheet loading plate 72. An end portion of the lift-up shaft 76 on the front side F is rotatably held by a side wall on the front side F on the leading side L of the housing 71. An end portion of the lift-up shaft 76 on the rear side R is inserted through and rotatably held by a side wall on the rear side R on the leading side L of the housing 71. The lift-up shaft 76 is positioned so as to pass through a space between the upper portion of the lower surface of the housing 71 and a lower surface of the sheet loading plate 72. The crank-shaped lift-up arm portion 76*a* is formed in a portion of the lift-up shaft 76 located below the sheet loading plate 72 by partially bending the lift-up shaft 76. The lift-up arm portion 76*a* protrudes toward the leading side L when seen from the lift-up shaft 76.

Furthermore, the sheet containing portion 70 includes a driven gear 77 and a first sector gear 78. The driven gear 77 is secured to the lift-up shaft 76 at a portion of the lift-up shaft 76 protruding outward from the side wall of the housing 71 on the rear side R. The first sector gear 78 is secured to the lift-up shaft 76 in a portion inside the side wall of the housing 71 on the rear side R and further toward the rear side R than the rear side R of the end portion of the sheet loading plate 72 provided in the housing 71 is. Here, the first sector gear 78 is attached to the lift-up shaft 76 so that the teeth thereof face the trailing side T.

The sheet containing portion 70 includes a transmission gear 79, which is provided so as to be engaged with the first sector gear 78. An end of the transmission gear 79 is rotatably attached to a gear shaft 79*a* that protrudes from the rear side R of the rear side guide 75 on the leading side L. The position at which the gear shaft 79*a* is attached to the rear side guide 75 is further toward the leading side L than a portion where the opening 75*a* is formed is.

The sheet containing portion 70 also includes the blowing unit 80 provided on the rear side R when seen from the rear side guide 75 and on the front side F relative to the side wall of the housing 71 on the rear side R. The blowing unit 80 blows air through the opening 75*a* formed in the rear side guide 75 to the stack of sheets S loaded on the sheet loading plate 72. The blowing unit 80 serving as an example of a blowing section includes a blower 81, a blower support bracket 82, a blower support shaft 83, and a second sector gear 84. The blower 81 sends air through the blowing opening 81*a*. The blower support bracket 82 supports the blower 81 in a fixed manner. The blower support bracket 82 is secured to the blower support shaft 83, by which the blower 81 is rotatably supported through the blower support bracket 82. The second sector gear 84 is secured to the blower support shaft 83 and engaged with the above-described transmission gear 79.

The blower 81 according to the present exemplary embodiment uses an axial flow fan, a sirocco fan, a cross flow fan, or the like. In the present example, the blowing opening 81*a*, through which an air flow generated by the blower 81 is output to the outside, has a rectangular shape. Power is supplied to the blower 81 from a power source (not shown) provided on the body side of the image forming apparatus 1 through electrical wiring (not shown).

An end portion of the blower support shaft 83 on the front side F is rotatably held by the rear side guide 75, and an end portion of the blower support shaft 83 on the rear side R is rotatably held by the side wall of the housing 71 on the rear side R. The blower support shaft 83 is held by the rear side guide 75 on the leading side L relative to the opening 75*a* formed in the rear side guide 75 and on the trailing side T relative to the gear shaft 79*a* attached to the rear side guide 75.

The blower 81, which is rotatably supported by the blower support shaft 83 through the blower support bracket 82, is attached to the blower support shaft 83 on the trailing side T when seen from the blower support shaft 83. The blowing opening 81*a* is formed in the blower 81 such that the blowing opening 81*a* opposes the opening 75*a* formed in the rear side guide 75 and has a longer side in an arrow A direction that extends from the trailing side T toward the leading side L.

The second sector gear 84 is secured to the blower support shaft 83 such that the teeth thereof face the leading side L.

In the present exemplary embodiment, inclination (blowing angle) of the blowing opening 81*a* formed in the blower 81 is adjustable through the movement of the blower 81 in a rotational direction about the blower support shaft 83. Thus, the size of the opening 75*a* formed in the rear side guide 75 is set in accordance with the movable range of the blowing opening 81*a*.

In the present exemplary embodiment, the driven gear 77 and the lift-up shaft 76 including the lift-up arm portion 76*a* have the function of an inclination section or an inclination unit, and the first sector gear 78, the transmission gear 79, and the second sector gear 84 have the function of a setting section or a setting unit.

In the present exemplary embodiment, as illustrated in FIG. 5, a lift-up drive unit 100 is provided outside the side wall of the housing 71 on the rear side R. The lift-up drive unit 100 causes the lift-up shaft 76 to rotate via the driven gear 77. The lift-up drive unit 100 includes a lift-up drive motor 101 and a drive gear 102. The lift-up drive motor 101 is secured to a frame (not shown) provided in the body of the image forming apparatus 1. The drive gear 102 is secured to a drive shaft of the lift-up drive motor 101. In the present exemplary embodiment, when the sheet containing portion 70 is pushed into the body of the image forming apparatus 1 from the front side F so as to be accommodated in the body of the image forming apparatus 1, the drive gear 102 provided in the lift-up drive unit 100 and the driven gear 77 provided in the sheet containing portion 70 are brought into engagement with each other. When the sheet containing portion 70 is pulled out of the body of the image forming apparatus 1 to the front side F, the drive gear 102 and the driven gear 77 are disengaged from each other.

Next, the configuration of the sheet feed mechanism 90 of the first sheet feeding unit 21 is described.

The sheet feed mechanism 90 is provided on the leading side L relative to the sheet containing portion 70 on the upper side of the sheet containing portion 70. The sheet feed mechanism 90 includes a pickup roller 91 and a separation mechanism. The pickup roller 91 is rotatably provided on the upper side of the sheet containing portion 70 on the leading side L when seen from the sheets S loaded on the sheet loading plate 72 of the sheet containing portion 70. The pickup roller 91 is brought into contact with the uppermost sheet S out of a stack of the sheets S loaded on the sheet loading plate 72 of the sheet containing portion 70 and delivers the uppermost sheet S in the arrow A direction. The separation mechanism separates the sheets S being transported so that the sheets S are separated from one another on the leading side L relative to the pickup roller 91, that is, on the downstream side in the arrow A direction even when multiple feeding of the sheets S occurs.

The separation mechanism according to the present exemplary embodiment includes feed rollers 92 and retard rollers 93. The feed rollers 92 are disposed above a sheet feeding path, through which the sheet S is transported, and are rotatable in an arrow B direction. The retard rollers 93 are disposed so as to oppose the corresponding feed rollers 92 with the sheet feeding path therebetween and are rotatable in the forward and opposite directions. Here, the retard rollers 93 are driven so as to rotate in a direction opposite to the arrow A direction at a portion opposite the feed rollers 92. A torque limiter (not shown) is attached to each retard roller 93. The pickup roller 91, the feed rollers 92, and the retard rollers 93 according to the present exemplary embodiment are each use rubber rollers.

The sheet feed mechanism 90 according to the present exemplary embodiment is rotatable about a rotation axis of the feed rollers 92 and is provided with a support frame 94. The pickup roller 91 is rotatably supported by the support frame 94 on a free end side of the support frame 94. A solenoid (not shown) is attached to the support frame 94. The pickup roller 91 serving as an example of a delivery section or a delivery member moves up and down in arrow C directions indicated in FIG. 2 through the solenoid and the support frame 94.

Furthermore, the sheet feed mechanism 90 according to the present exemplary embodiment includes a level sensor 95. The level sensor 95 is secured to a housing (not denoted by a reference numeral) of the sheet feed mechanism 90 on the free end side of the support frame 94 and detects the position (height) of the free end of the support frame 94, the position being changed in accordance with the movement of the support frame 94 in the arrow C directions.

Next, operation of the sheet feeding arrangement 20 provided in the image forming apparatus 1 is described with the above-described first sheet feeding unit 21 as an example.

In the description below, "initial setting operation", which is performed along with replenishment of the sheet containing portion 70 with the sheets S performed while image forming operation is not performed, is initially described. Then, "sheet feeding operation", which is performed along with image forming operation, is described. Furthermore, "resetting operation", which is performed as a result of a decrease in the number of sheets S contained in the sheet containing portion 70 due to image forming operation, is described.

Initial Setting Operation

The initial setting operation is described. Here, the initial setting operation is actually performed in conjunction with pulling of the sheet containing portion 70 relative to the image forming apparatus 1 and the following pushing of the sheet containing portion 70 regardless of whether or not the sheet containing portion 70 is replenished with the sheet S.

In an initial state before the start of the initial setting operation, the lift-up arm portion 76*a* formed in the lift-up shaft 76 of the sheet containing portion 70 is directed toward the leading side L as illustrated, for example, in FIG. 2. As a result, the sheet loading plate 72 is almost not inclined and in a substantially horizontal position. Also in the initial state, the blower 81 provided in the sheet containing portion 70 stops blowing air. In the initial state, the support frame 94 provided in the sheet feed mechanism 90 is at a position illustrated by solid lines in FIG. 2. As a result, the pickup roller 91 attached to the support frame 94 is at a position illustrated by a solid circle in FIG. 2 (referred to as a stand-by position hereafter). Also in the initial state, the pickup roller 91, the feed rollers 92, and the retard rollers 93, which are provided in the sheet feed mechanism 90, stop rotating.

When the sheet containing portion 70 is pulled toward the front side F of the image forming apparatus 1 and then pushed into the image forming apparatus 1, that is, toward the rear side R, as described above, the drive gear 102 of the lift-up drive unit 100 provided in the image forming apparatus 1 side and the driven gear 77 provided in the sheet containing portion 70 side are brought into engagement with each other. Next, when a sensor (not shown) detects the attachment (positioning) of the sheet containing portion 70 due to pushing of the sheet containing portion 70 into the image forming apparatus 1, the controller 60 causes the solenoid (not shown) to rotate counterclockwise in FIG. 2 the support frame 94 provided in the sheet feed mechanism 90. This causes the pickup roller 91 attached to the support frame 94 to move to a lowest position the pickup roller 91 is allowed to move and stop.

At this time, the controller 60 monitors whether or not the level sensor 95 detects the support frame 94 that supports the pickup roller 91 in accordance with a detection result from the level sensor 95 provided in the sheet feed mechanism 90. If the controller 60 determines that the level sensor 95 does not detect the support frame 94 (the pickup roller 91 supported by the support frame 94 is at a position shifted to a position lower than a target delivery position (a position indicated by a dashed circle in FIG. 2; the details will be described later)), the controller 60 causes the lift-up drive motor 101 provided in the lift-up drive unit 100 to drive, thereby rotating counterclockwise the lift-up shaft 76 in FIG. 2, which is connected to the lift-up drive unit 100 via the driven gear 77. At this time, the lift-up arm portion 76*a* formed in the lift-up shaft 76 also rotates counterclockwise about the lift-up shaft 76 (in an arrow D direction in FIG. 3) in FIG. 2. As the lift-up arm portion 76*a* rotates, the sheet loading plate 72, on which the stack of sheets S are loaded, gradually rotates counterclockwise about the support shaft 72*a* in FIG. 2. Thus, an angle (lifting angle) at which the sheet loading plate 72 is inclined relative to the lower surface of the housing 71 gradually increases, and accordingly, the posture of the stack of sheets S loaded on the sheet loading plate 72 is changing such that the leading side L of the stack of sheets S is lifted further upward than the trailing side T of the stack of sheets S is. At this time, the pickup roller 91 is moved upward by the sheets S. The fact that the level sensor 95 detects the support frame 94 triggers the controller 60 to cause the lift-up drive unit 100 to stop driving, and then, cause the support frame 94 provided in the sheet feed mechanism 90 to rotate clockwise in FIG. 2 and the pickup roller 91 to stop at the stand-by position of the pickup roller 91.

In the first sheet feeding unit 21 according to the present exemplary embodiment, a blower angle of the blowing unit 80 (more specifically, the blowing opening 81*a* of the blower 81) is also adjusted using the first sector gear 78, which is attached to the lift-up shaft 76, in conjunction with adjustment of the lifting angle of the sheet loading plate 72 using the lift-up arm portion 76*a* of the lift-up shaft 76.

That is, when the lift-up shaft 76 is rotated counterclockwise in FIG. 6B by the lift-up drive unit 100, the first sector gear 78 attached to the lift-up shaft 76 is also rotated counterclockwise. Counterclockwise rotation of the first sector gear 78 causes the transmission gear 79 engaged with the first sector gear 78 to rotate clockwise, thereby causing the second sector gear 84 engaged with the transmission gear 79 to rotate counterclockwise. As the second sector gear 84 rotates counterclockwise, the blower support shaft 83 attached to the second sector gear 84 also rotates counterclockwise, thereby causing the blower 81 attached to the blower support shaft 83 through the blower support bracket 82 to rotate counterclockwise. This gradually increases an angle (blowing angle) formed between the blowing opening 81*a*, which is formed in the blower 81, and the lower surface of the housing 71. As described above, as detection of the support frame 94 performed by the level sensor 95 triggers the lift-up drive unit 100 to stop driving, rotation of each component is ended and the blowing opening 81*a* formed in the blower 81 is stopped at a position in accordance with the amount of the rotation of the blower 81.

Thus, the initial setting operation is completed. The resultant state is maintained and a stand-by state is entered until the sheet feeding operation is started or the sheet containing portion 70 is again pulled toward the front side F.

Here, when the first sheet feeding unit 21 is in the first state illustrated in, for example, FIG. 2, the sheet containing portion 70 is fully loaded with the sheets S, and accordingly, the pickup roller 91 at a position illustrated by the dashed circle in FIG. 2 is in contact with the uppermost sheet S. Thus, when the first sheet feeding unit 21 is in the first state, drive using the lift-up drive unit 100 is not performed in the initial setting operation. As a result, both the lift-up arm portion 76*a* of the lift-up shaft 76 and the sheet loading plate 72 on which the stack of sheets S are loaded are maintained in the respective horizontal positions. The position of the pickup roller 91 in FIG. 2 indicated by the dashed circle is a delivery position at which the pickup roller 91 is positioned when delivering the sheet S in the sheet feeding operation, which will be described later. When the pickup roller 91 is at the delivery position, an upper portion of the support frame 94, which supports the pickup roller 91, on the free end side blocks a sensing position of the level sensor 95.

When the first sheet feeding unit 21 is in the first state illustrated in, for example, FIG. 2, the opening 75*a* formed in the rear side guide 75 and the blowing opening 81*a* formed in the blower 81 of the blowing unit 80 is arranged in a positional relationship illustrated in FIG. 6B. That is, the blowing opening 81*a* is positioned at an upper position in the opening 75*a* and the longitudinal direction of the blowing opening 81*a* is set in a horizontal direction.

In contrast, when the first sheet feeding unit 21 is in the second state illustrated in, for example, FIG. 3, the sheet containing portion 70 is loaded with half as many sheets S as is possible, and accordingly, the pickup roller 91 stops at a position lower than the delivery position indicated by the dashed circle in FIG. 3. Thus, when the first sheet feeding unit 21 is in the second state, drive using the lift-up drive unit 100 is performed in the initial setting operation. As a result, both the lift-up arm portion 76*a* of the lift-up shaft 76 and the sheet loading plate 72 on which the stack of sheets S are loaded are inclined.

When the first sheet feeding unit 21 is in the second state illustrated in, for example, FIG. 3, the opening 75*a* formed in the rear side guide 75 and the blowing opening 81*a* formed in the blower 81 of the blowing unit 80 is arranged in a positional relationship illustrated in FIG. 6C. That is, the position of the blowing opening 81*a* in the opening 75*a* is positioned at a lower position with respect to that in the case illustrated in FIG. 6B, and the longitudinal direction of the blowing opening 81*a* is lifted upward from the trailing side T toward the leading side L.

As described above, in the present exemplary embodiment, both the lifting angle of the sheet loading plate 72 and the blowing angle of the blowing opening 81*a* formed in the blower 81 are adjusted in an interlocked manner in accordance with the quantity of sheets S contained in the sheet containing portion 70. Here, at the end of the initial setting operation, the blowing opening 81*a* stops at a position opposite the plural sheets S including the uppermost sheet S out of the stack of sheets S loaded on the sheet loading plate 72 in the first state illustrated in FIGS. 2 and 6B and in the second state illustrated in FIGS. 3 and 6C.

[Sheet Feeding Operation]

Next, the sheet feeding operation is described.

In the pre-sheet feeding state before the start of the sheet feeding operation, the blower 81 provided in the sheet containing portion 70 stops blowing air. In the pre-sheet feeding state, the support frame 94 provided in the sheet feed mechanism 90 is at a position indicated by the solid lines in FIG. 2. As a result, the pickup roller 91 attached to the support frame 94 is at the stand-by position indicated by the solid circle in FIG. 2. Also in the pre-sheet feeding state, the pickup roller 91, the feed rollers 92, and the retard rollers 93, which are provided in the sheet feed mechanism 90, stop rotating.

As the above-described image forming operation is started, the blower 81 starts blowing air the sheet containing portion 70. When the image forming operation is started, the pickup roller 91, the feed rollers 92, and the retard rollers 93 start to rotate in the sheet feed mechanism 90.

When the blower 81 stars to blow air in the sheet containing portion 70, an air flow generated by the blower 81 is supplied through the blowing opening 81*a* formed in the blower 81 and then through the opening 75*a* formed in the rear side guide 75 toward a portion above the sheet loading plate 72. Here, in the present exemplary embodiment, the lifting angle by which the stack of the sheets S are lifted upward and the corresponding blowing angle of the blowing opening 81*a* are adjusted in the above-described initial setting operation.

Figure 7A:
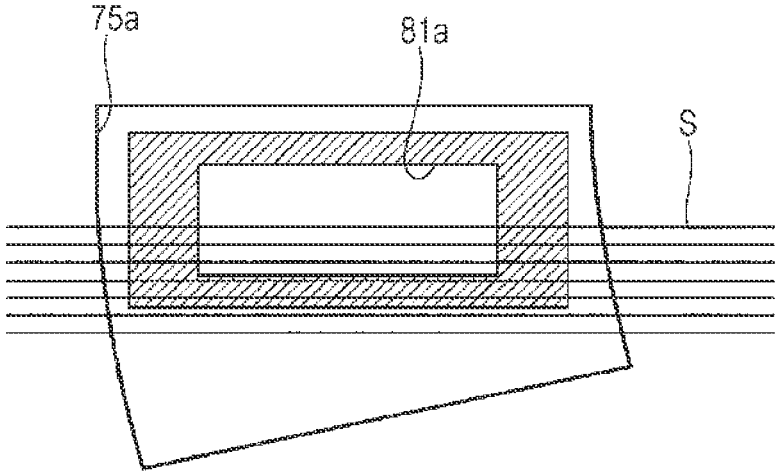
FIGS. 7A and 7B illustrate the relationship between a state in which the sheets are loaded in the first sheet feeding unit and the position of the blowing opening.
Figure 7B:
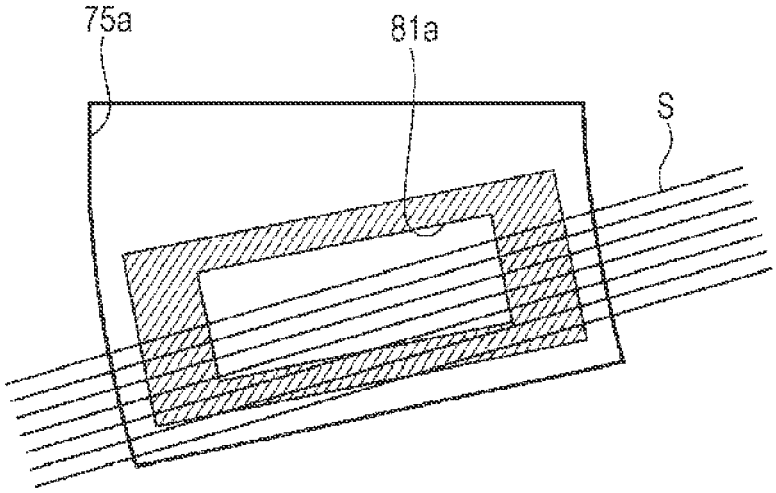

FIGS. 7A and 7B illustrate the relationship between a state in which the sheets S are loaded in the first sheet feeding unit 21 and the position of the blowing opening 81*a*. FIG. 7A illustrates the relationship when the first sheet feeding unit 21 is in the first state illustrated in FIGS. 2 and 6B in the initial setting operation. FIG. 7B illustrates the relationship when the first sheet feeding unit 21 is in the second state illustrated in FIGS. 3 and 6C in the initial setting operation.

As illustrated in FIG. 7A, in the first state, the blowing opening 81*a* is in an almost parallel relationship with the plural sheets S loaded on the sheet loading plate 72 (not illustrated in FIG. 7A). At this time, the uppermost sheet S out of the stack of the sheets S exists at a position opposing a central portion of the blowing opening 81*a* in the short side direction.

As illustrated in FIG. 7B, in the second state, the blowing opening 81*a* continues to be in the almost parallel relationship with the plural sheets S loaded on the sheet loading plate 72 (not illustrated in FIG. 7B) although the degree of parallelism is decreased compared to that in the first state. At this time, the uppermost sheet S out of the stack of the sheets S exists at the position opposing the central portion of the blowing opening 81*a* in the short side direction.

Thus, in both the first state and second state, the air flow supplied through the blowing opening 81*a* blows toward an end portion on the rear side R of the plural sheets S including the uppermost sheet S out of the stack of sheets S loaded on the sheet loading plate 72. As a result, air enters between the plural sheets S. This facilitates decreasing of the degree of tightness with which the adjacent sheets S of the plural sheets S are in contact with each other.

When the rotation in the sheet feed mechanism 90 is started, the pickup roller 91 rotates counterclockwise in FIG. 2. Along with the start of the rotation in the sheet feed mechanism 90, the feed rollers 92 and the retard rollers 93, which are included in the separation mechanism, attempt to rotate in the same direction (counterclockwise in FIG. 2, arrow B direction). However, at this time, the feed rollers 92 and the corresponding retard rollers 93 are in direct contact with each other. Furthermore, directions in which the feed rollers 92 and the retard rollers 93 attempt to rotate are opposite to each other in separation nips where the feed rollers 92 and the corresponding retard rollers 93 oppose (contact) each other. Here, in the present exemplary embodiment, forces in the tangential direction (tangential forces) applied to the sheet S by retard rollers 93 are smaller than those applied by the feed rollers 92. Thus, in the separation mechanism, the feed rollers 92 rotate in the arrow B direction and the retard rollers 93 are dragged back by the corresponding feed rollers 92 due to drive forces applied by the feed rollers 92.

Upon receipt of an instruction from the controller 60 for the start of sheet feeding, the sheet feed mechanism 90 causes the support frame 94 to rotate counterclockwise in FIG. 2 using the solenoid (not shown). This causes the pickup roller 91 attached to the support frame 94 to move to and stop at a position at which the pickup roller 91 is brought into contact with the uppermost sheet S out of the stack of sheets S loaded on the sheet loading plate 72 of the sheet containing portion 70. Here, in the present exemplary embodiment, since the lifting angle by which the stack of sheets S are lifted upward is adjusted in the above-described initial setting operation, the pickup roller 91 is brought into contact with the uppermost sheet S at the delivery position, which is indicated by the dashed circle in FIG. 2.

When the pickup roller 91 is brought into contact with the upper surface of the uppermost sheet S, the uppermost sheet S is started to be transported by the pickup roller 91, which is being rotated, in the arrow A direction.

At this time, as described above, air is blown by the blowing unit 80 toward the end portion on the rear side R of the stack of sheets S including the uppermost sheet S. This separates the uppermost sheet S from the adjacent sheet S due to air blow before the pickup roller 91 starts to deliver the uppermost sheet S. This facilitates delivery of only the uppermost sheet S out of the stack of sheets S by the pickup roller 91.

Next, as a result of transportation of the sheet S, which is delivered from the sheet containing portion 70 by the pickup roller 91, in the arrow A direction, the sheet S reaches the separation mechanism, that is, the separation nips where the feed rollers 92 and the corresponding retard rollers 93 oppose each other.

Here, in the case where, for example, just a single sheet S is delivered by the pickup roller 91, the feed rollers 92 are brought into contact with the upper surface of the sheet S and the retard rollers 93 are brought into contact with the lower surface of the sheet S in the separation mechanism. At this time, the sheet S continues to be transported in the arrow A direction by the feed rollers 92 that rotate in the arrow B direction. The retard rollers 93, which are driven so as to rotate in a direction opposite to the arrow A direction in the separation nips, is dragged by the feed rollers 92 through the sheet S due to the tangential forces applied through the sheet S being transported in the arrow A direction by the feed rollers 92.

In contrast, in the case where, for example, two sheets S superposed on each other are delivered by the pickup roller 91, the feed rollers 92 are brought into contact with the upper surface of the first sheet S and the retard rollers 93 are brought into contact with the lower surface of the second sheet S, which is positioned below the first sheet S, in the separation mechanism. At this time, the first sheet S continues to be transported in the arrow A direction by the feed rollers 92 that rotate in the arrow B direction. Since a frictional forces acting between the lower surface of the second sheet S and the retard rollers 93 is greater than those acting between the lower surface of the first sheet S and the upper surface of the second sheet S, the second sheet S is moved backward in a direction opposite to the arrow A direction, that is, toward the sheet containing portion 70 by the retard rollers 93, which are subjected to drive forces in the separation nips in the direction opposite to the arrow A direction. Thus, even if multiple feeding of the sheets S is caused by the pickup roller 91, the sheets S is allowed to be output one after another from the first sheet feeding unit 21 to the sheet transport unit 30.

After the sheet S delivered by the pickup roller 91 has entered the separation nips of the separation mechanism, the controller 60 causes the support frame 94 provided in the sheet feed mechanism 90 to move from the position illustrated in the dashed lines to the position illustrated in the solid lines in FIG. 2 using the solenoid (not shown). In conjunction with the movement of the support frame 94, the pickup roller 91 attached to the support frame 94 moves from the delivery position to the stand-by position. This moves the pickup roller 91 away from the stack of sheets S loaded on the sheet loading plate 72.

In the case where image forming is performed continuously on the plural sheets S, upon receipt of the next instruction from the controller 60 for the start of sheet feeding, the support frame 94 provided in the sheet feed mechanism 90 is moved from the position illustrated in the solid lines to the position illustrated in the dashed lines in FIG. 2 using the solenoid (not shown), thereby moving again the pickup roller 91 from the stand-by position to the delivery position. After that, the next sheet S will be fed by repeating the above-described procedure.

Resetting Operation

Next, the resetting operation is described.

In the above-described image forming operation (sheet feeding operation), when the sheets S are sequentially output from, for example, the first sheet feeding unit 21, the quantity of sheets S contained in the sheet containing portion 70 of the first sheet feeding unit 21 gradually decreases. For this reason, the position (height) of the uppermost sheet S of the stack of sheets S gradually moves down unless the lifting angle of the sheet loading plate 72 is changed. This leads to a situation in which the pickup roller 91 is not allowed to deliver the uppermost sheet S. Thus, in the present exemplary embodiment, a setting (resetting), in which the lifting angle of the sheet loading plate 72 is increased, is performed in accordance with a decrease in the quantity of the sheets S contained in the sheet containing portion 70. Furthermore, in the present exemplary embodiment, as described above, in conjunction with the setting of the lifting angle of the sheet loading plate 72, the blowing angle of the blowing opening 81*a* formed in the blower 81 of the blowing unit 80 is also set (reset).

When the quantity of sheets S loaded on the sheet loading plate 72 decreases as feeding of the sheets S continues, the pickup roller 91 is moved down beyond the delivery position in the movement of the pickup roller 91 from the stand-by position to the delivery position. Thus, the level sensor 95 does not detect the support frame 94 that supports the pickup roller 91. In the present exemplary embodiment, the controller 60 monitors detection of the support frame 94 performed by the level sensor 95 while the sheet feeding operation is performed. In the case where it is determined that the support frame 94 is not detected by the level sensor 95 when the pickup roller 91 is moved down, the controller 60 causes the lift-up drive motor 101 provided in the lift-up drive unit 100 to drive so as to rotate the lift-up shaft 76 connected to the lift-up drive unit 100 via the driven gear 77 counterclockwise in FIG. 2 by a predetermined amount. As a result, the leading side L of the sheet loading plate 72 is further moved up by the lift-up arm portion 76*a* formed in the lift-up shaft 76, and accordingly, the lifting angle gradually increases. When the support frame 94 is detected by the level sensor 95, this detection triggers the controller 60 to stop driving of the lift-up drive unit 100.

When the lift-up shaft 76 rotates, the blowing angle of the blowing opening 81*a* formed in the blower 81 also gradually increases. At this time, the position of the blowing opening 81*a* as the whole moves downward compared to that before the movement. As described above, detection of the support frame 94 performed by the level sensor 95 triggers the blowing opening 81*a* formed in the blower 81 to stop at a position in accordance with the amount of the rotation of the blower 81.

Thus, the resetting operation is completed. However, this resetting operation is repeatedly performed every time the situation in which the support frame 94 is not detected by the level sensor 95 occurs in accordance with the decrease in the number of sheets S contained in the sheet containing portion 70.

Here, a case in which the state of the first sheet feeding unit 21 changes from the first state illustrated in FIGS. 2, 6B, and 7A to the second state illustrated in FIGS. 3, 6C, and 7B in accordance with feeding of the sheets S is discussed. In this case, the lifting angle of the sheet loading plate 72 increases every time one or plural sheets S are output, and accordingly, the blowing angle of the blowing opening 81*a* formed in the blower 81 also increases in conjunction with the increase in the lifting angle of the sheet loading plate 72.

In the first sheet feeding unit 21 according to the present exemplary embodiment, the above-described initial setting operation and the resetting operation are performed such that the pickup roller 91 at the delivery position is brought into contact with the upper surface of the uppermost sheet S out of the stack of sheets S loaded on the sheet loading plate 72. The initial setting operation and the resetting operation are similarly performed in the second to fourth sheet feeding units 22 to 24.

Second Exemplary Embodiment

In the first exemplary embodiment, adjustment of the lifting angle of the sheet loading plate 72 and adjustment of the blowing angle of the blowing opening 81*a* of the blower 81 are performed as an integrated operation by rotating the lift-up shaft 76. In contrast, according to a second exemplary embodiment, adjustment of the lifting angle of the sheet loading plate 72 and adjustment of the blowing angle of the blowing opening 81*a* of the blower 81 are independently performed. In the present exemplary embodiment, the elements similar to those in the first exemplary embodiment are denoted by the similar reference signs and detailed description thereof is omitted.

Figure 8:
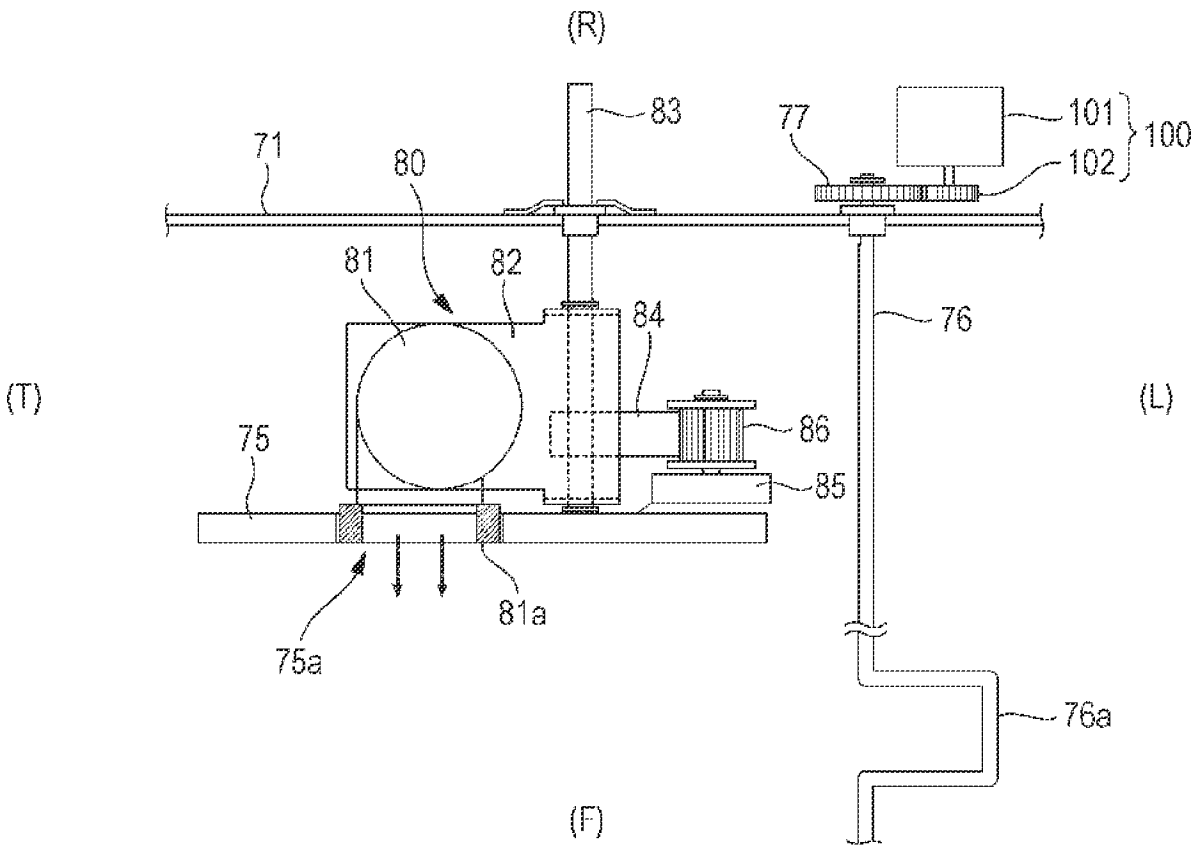
FIG. 8 is an enlarged top view of a blowing unit and an area around the blowing unit of a first sheet feeding unit according to a second exemplary embodiment.
Figure 9A:
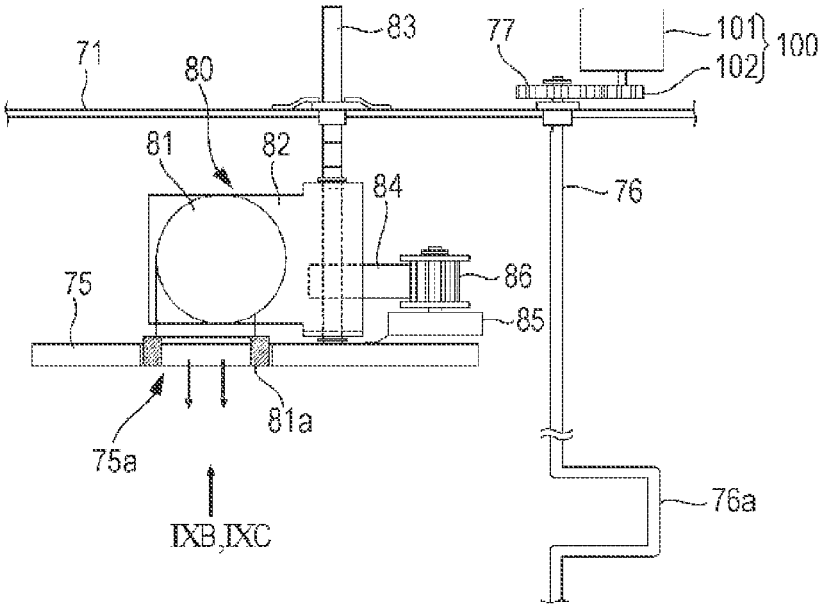
FIGS. 9A to 9C illustrate behaviors of a lift-up arm portion and a blowing opening of the first sheet feeding unit according to the second exemplary embodiment.
Figure 9B:
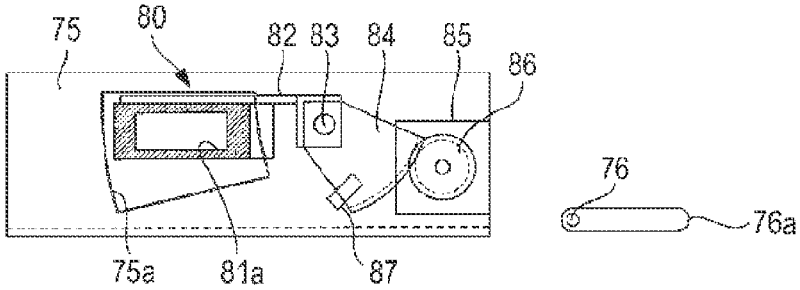
Figure 9C:
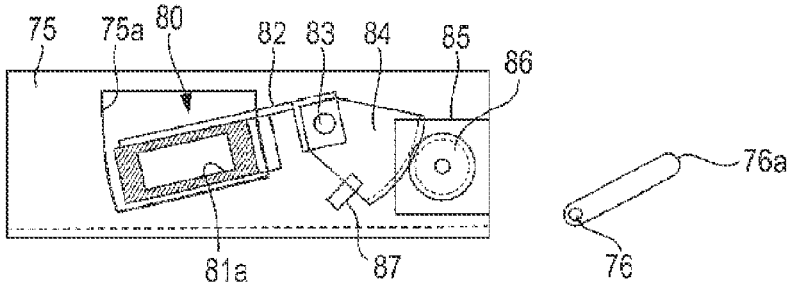

FIG. 8 is an enlarged top view of the blowing unit 80 and an area around the blowing unit 80 of the first sheet feeding unit 21 according to the present exemplary embodiment. FIGS. 9A to 9C illustrate behaviors of the lift-up arm portion 76*a* and the blowing opening 81*a* in the first sheet feeding unit 21 according to the present exemplary embodiment. Out of FIGS. 9A to 9C, FIG. 9A is an enlarged top view of the blowing unit 80 and the area around the blowing unit 80 (similar to FIG. 8), FIG. 9B illustrates the first sheet feeding unit 21 in the first state illustrated in FIG. 2 seen in a IXB direction indicated in FIG. 9A, and FIG. 9C illustrates the first sheet feeding unit 21 in the second state illustrated in FIG. 3 seen in a IXC direction indicated in FIG. 9A. Here, the first sheet feeding unit 21 according to the present exemplary embodiment also includes the sheet containing portion 70 and the sheet feed mechanism 90, and the blowing unit 80 is provided on the sheet containing portion 70 side.

The lift-up shaft 76 according to the present exemplary embodiment has the lift-up arm portion 76*a*, which is the same as that according to the first exemplary embodiment. However, the first sector gear 78 and the transmission gear 79 (including the gear shaft 79*a*), which are provided to set the position of the blowing unit 80 in the first exemplary embodiment, is not attached to the lift-up shaft 76 according to the present exemplary embodiment.

The blowing unit 80 according to the present exemplary embodiment further includes a blower position setting motor 85, a drive gear 86, and a light-blocking sensor 87 in addition to the blower 81, the blower support bracket 82, the blower support shaft 83, and the second sector gear 84, which have been described in the first exemplary embodiment.

The blower position setting motor 85 is attached to the rear side guide 75 on the leading side L on the rear side R and a drive shaft thereof protrudes toward the rear side R. The drive gear 86 is secured to the drive shaft of the blower position setting motor 85 and engaged with the second sector gear 84. The light-blocking sensor 87 is secured to the rear side guide 75 on the rear side R and detects changes in position of the second sector gear 84 as the second sector gear 84 rotates.

Also in the first sheet feeding unit 21 according to the present exemplary embodiment, the "initial setting operation", the "sheet feeding operation", and the "resetting operation" are performed similarly to those in the first exemplary embodiment. In the initial setting operation and the resetting operation, the following operations are performed in parallel: rotation of the lift-up shaft 76 using the lift-up drive motor 101 and the resulting adjustment of the lifting angle of the sheet loading plate 72; and rotation of the blower support shaft 83 using the blower position setting motor 85 and the resulting adjustment of the blowing angle of the blowing opening 81*a*. The techniques in which the lifting angle and the blowing angle are set are the same as that described in the first exemplary embodiment.

In the first and second exemplary embodiments, the blower support shaft 83, about which the blowing opening 81*a* of the blowing unit 80 rotates, is provided in the rear side guide 75. However, this is not limiting where the blower support shaft 83 is provided. As the distance between the position at which the blower support shaft 83 is attached and a portion in which the pickup roller 91 disposed at the delivery position is brought into contact with the uppermost sheet S is decreased, the degree of parallelism between the stack of sheets S and the blowing opening 81*a* may be improved.

Although in the first and second exemplary embodiments, the blowing angle and the position (height) of the blowing opening 81*a* are adjusted by moving the blowing opening 81*a* in rotational directions, the way in which the blowing angle and the position of the blowing opening 81*a* are adjusted is not limited to this. Alternatively, the position of the blowing opening 81*a* may be vertically and horizontally moved and the angle of the blowing opening 81*a* may be adjusted in addition to the vertical and horizontal movement.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet feeding device comprising:

a loading section, sheets being loaded on the loading section;

a delivery section configured to sequentially deliver the sheets from a top of a stack of the sheets loaded on the loading section, the stack of sheets having a side surface;

a blowing section comprising a blowing opening facing the side surface of the stack of sheets loaded on the loading section and configured to blow air toward the side surface of the stack of sheets through the blowing opening;

an inclination section configured to rotate the stack of sheets loaded on the loading section in accordance with the quantity of the sheets loaded on the loading section; and a setting section configured to rotate the blowing opening of the blowing section in accordance with an amount of rotation of the stack of sheets that are inclined by the inclination section.

2. The sheet feeding device according to claim 1, wherein the inclination section is configured to further rotate the stack of sheets loaded on the loading section in response to the quantity of the sheets loaded on the loading section decreasing, and wherein the setting section is configured to reset the position of the blowing opening of the blowing section in accordance with a change in an amount of inclination of the inclination section.

3. The sheet feeding device according to claim 1, wherein the inclination section is configured to rotate the stack of sheets loaded on the loading section such that, with respect to a moving direction of the sheets delivered by the delivery section, a downstream side of the stack of sheets is lifted higher than an upstream side of the stack of sheets.

4. The sheet feeding device according to claim 1, wherein the blowing opening is configured to rotate with respect to a first axis and the inclination section is configured to rotate with respect to a second axis, wherein the first and second axes are parallel from each other.

5. The sheet feeding device according to claim 1, wherein the blowing opening is configured to maintain a constant distance from the side surface of the stack of sheets while the blowing opening is rotated.

6. A sheet feeding device comprising:

a loading member, sheets being loaded on the loading member;

a delivery member configured to contact an uppermost sheet out of a stack of the sheets loaded on the loading member and configured to deliver the uppermost sheet, the stack of sheets having a side surface, the uppermost sheet having a side end;

an inclination unit configured to rotate the loading member to be gradually inclined such that, with respect to a moving direction of the sheets delivered by the delivery member, a downstream side of the loading member is lifted higher than an upstream side of the loading member as quantity of the sheets included in the stack of sheets loaded on the loading member decreases;

a blowing unit comprising a blowing opening and facing the side surface of the stack of sheets loaded on the loading member, the blowing unit configured to blow air toward the side surface of the stack of sheets through the blowing opening; and a movement unit configured to gradually rotate the blowing opening such that the blowing opening opposes the side end of the uppermost sheet out of the stack of sheets loaded on the loading member as the loading member becomes inclined.

7. The sheet feeding device according to claim 6, wherein the inclination unit is configured to drive the rotation of the movement unit and configured to rotate the position of the blowing opening.

8. A sheet containing device comprising:

a loading section, a stack of sheets being loaded on the loading section, the stack of sheets having a side surface;

a blower comprising a blowing opening facing the side surface of the stack of sheets loaded on the loading section, the blower configured to blow air toward the side surface of the stack of sheets through the blowing opening;

an inclination section configured to rotate the stack of sheets loaded on the loading section in accordance with the quantity of the sheets loaded on the loading section; and a setting section configured to set a position of the blowing opening of the blower by rotation of the blower in accordance with an amount of inclination of the inclination section.

9. An image forming apparatus comprising:

an image forming unit configured to form an image on a sheet; and a sheet feeding unit configured to feed the sheet to the image forming unit, wherein the sheet feeding unit comprises:

a loading section, the sheets being loaded on the loading section, a delivery section configured to sequentially deliver the sheets from a top of a stack of the sheets loaded on the loading section, the stack of sheets having a side surface, a blowing section comprising a blowing opening facing the side surface of the stack of sheets loaded on the loading section, the blowing section configured to blow air toward the side surface of the stack of sheets through the blowing opening, an inclination section configured to rotate the stack of sheets loaded on the loading section in accordance with a quantity of the sheets loaded on the loading section, and a setting section configured to rotate the blowing opening of the blowing section in accordance with an amount of inclination of the inclination section.

10. The image forming apparatus according to claim 9, wherein the sheet feeding unit is disposed at a lower position relative to the image forming unit.

* * * * *